US005201694A

United States Patent [19]

Zappel

[11] Patent Number: 5,201,694

[45] Date of Patent: Apr. 13, 1993

[54] SQUAT-PULL EXERCISE APPARATUS

[76] Inventor: Joseph Zappel, 22253 N. DeAnza Cir., Cupertino, Calif. 95014

[21] Appl. No.: 792,035

[22] Filed: Nov. 13, 1991

[51] Int. Cl.[5] ..... A63B 21/00

[52] U.S. Cl. ..... 482/133; 482/96; 482/21

[58] Field of Search ..... 482/91, 92, 93, 97, 482/111, 112, 114–116, 121, 122, 126, 129, 133, 135, 904

[56] References Cited

U.S. PATENT DOCUMENTS

| | | | |
|---|---|---|---|
| 935,854 | 10/1909 | Linerode . | |
| 1,075,309 | 10/1913 | Sullivan | 482/130 |
| 1,470,403 | 10/1923 | Thalken | 482/77 |
| 1,662,875 | 3/1928 | Young et al. . | |
| 2,201,036 | 5/1940 | Guerrier . | |
| 3,140,869 | 7/1964 | Pacuk . | |
| 3,420,522 | 1/1969 | Elliott . | |
| 3,716,231 | 2/1973 | Martin | 482/144 |
| 3,787,048 | 1/1974 | Bock | 482/145 |
| 4,101,124 | 7/1978 | Mahnke . | |
| 4,341,380 | 7/1982 | Sauders | 482/26 |
| 4,426,077 | 1/1984 | Becker | 482/112 |
| 5,120,289 | 6/1992 | Yu | 482/138 |

*Primary Examiner*—Richard J. Apley
*Assistant Examiner*—Jerome Donnelly
*Attorney, Agent, or Firm*—Schneck & McHugh

[57] ABSTRACT

An aerobic exercise device featuring a vertically movable seat counter-balanced mainly by a spring. As a user, supported by the seat, executes a squatting exercise the seat will urge the user toward an initial position. The seat moves vertically along an upright column having a pulley at its top. A cable connects the seat to a spring at the back side of the column via the pulley. Handles are suspended from arms at the top of the column to help a user support his or her weight.

12 Claims, 4 Drawing Sheets

SQUAT-PULL EXERCISE APPARATUS

TECHNICAL FIELD

The invention pertains to the field of exercise equipment, and in particular to those devices which offer the user an aerobic workout without the straining effects of strength building exercises. In recent years there have been many machines which offer aerobic exercise. The word "aerobic" refers to those exercises which raise heart rate and respiration rate for sustained intervals. This increases endurance and stamina to the muscle groups involved in the exercise while also providing muscle toning without the increased bulk normally associated with strength building activities. Other desirable results achieved by these activities include weight reduction, improved cardiac health, and increased endurance.

Machines offering this type of exercise include stair stepping machines mechanically simulating the action of climbing stairs; stationary bicycles which provide a variety of motion for both the legs and the arms; rowing machines which simulate the resistive action of oars in water, cross country skiing simulators and treadmills. These machines generally provide light resistance via mechanical friction, creating rotational motion, or by lifting weight against gravity.

Another apparatus described in U.S. Pat. No. 4,101,124 also provides an aerobic style exercise. The invention consists of a sled with rollers mounted on an inclined track. A person exercises by lying on the sled and working against gravity by sliding up and down on the track. This motion is accomplished by leg extension and by pulling on lines attached to the sled. The lines are directed through pulleys so that a downward force on the line causes the sled to move up along the tracks.

Each of these various devices provides a repetitive aerobic exercise but there are disadvantages to each. Many of the devices work a limited number of muscle groups, or place a strain on body areas such as the lower back. Stair stepping and rowing machines have a tendency to cause this type of fatigue because of both the working action of the machine and the user's need to support himself. Periods of exercise are usually several minutes long and muscles supporting the body, for example the lower back, may become strained. This is also a problem in seated exercises such as cycling or rowing where the upper body must remain upright; poor posture can result in improper use of the machine and possibly cause injury.

Problems also occur for people whose normal strength has been impaired by surgery or advanced age. These people often find that equipment offering a wide range of exercises normally requires a fitness level higher than their impaired condition may allow. There is a need for an improved aerobic exercise apparatus which supports the body and offers a thorough exercise with a wide range of difficulty to suit any fitness level.

SUMMARY OF THE INVENTION

The object of the invention is to provide an exercise apparatus which allows a user to achieve a thorough aerobic workout, yet reduces back and leg strain by dynamically supporting the person exercising. The apparatus consists of a vertically movable seat mounted on an upright column in a counter-balanced manner so that the seat is free to move vertically but is restrained with increasing force, as it moves from its rest position, by a force tending to restore the seat to its rest position. The seat counter-balance is a spring biasing system which provides a seat restraining force proportional to the distance the seat is forced down by a user from a starting or rest position. Handles are suspended above the seat so that a user may use his or her arms to help support his weight or perform pull-up type exercises. The handles and the seat are vertically adjustable to suit a variety of users. The counter force supporting the seat is variable.

The spring biasing means comprises a combination of a spring assembly and a lever. These are linked to the seat with a cable running through spring motion reducing pulleys. The lever provides a mechanical advantage, multiplying the spring force. The system works when a person forces the seat down the column by sitting on it. This makes a cable pull up on the lever via the pulleys which then stretches the springs. The magnitude of the upward force on the seat is controlled by changing the number of springs or the length of the lever arm.

DISCLOSURE OF THE INVENTION

Figure 1:
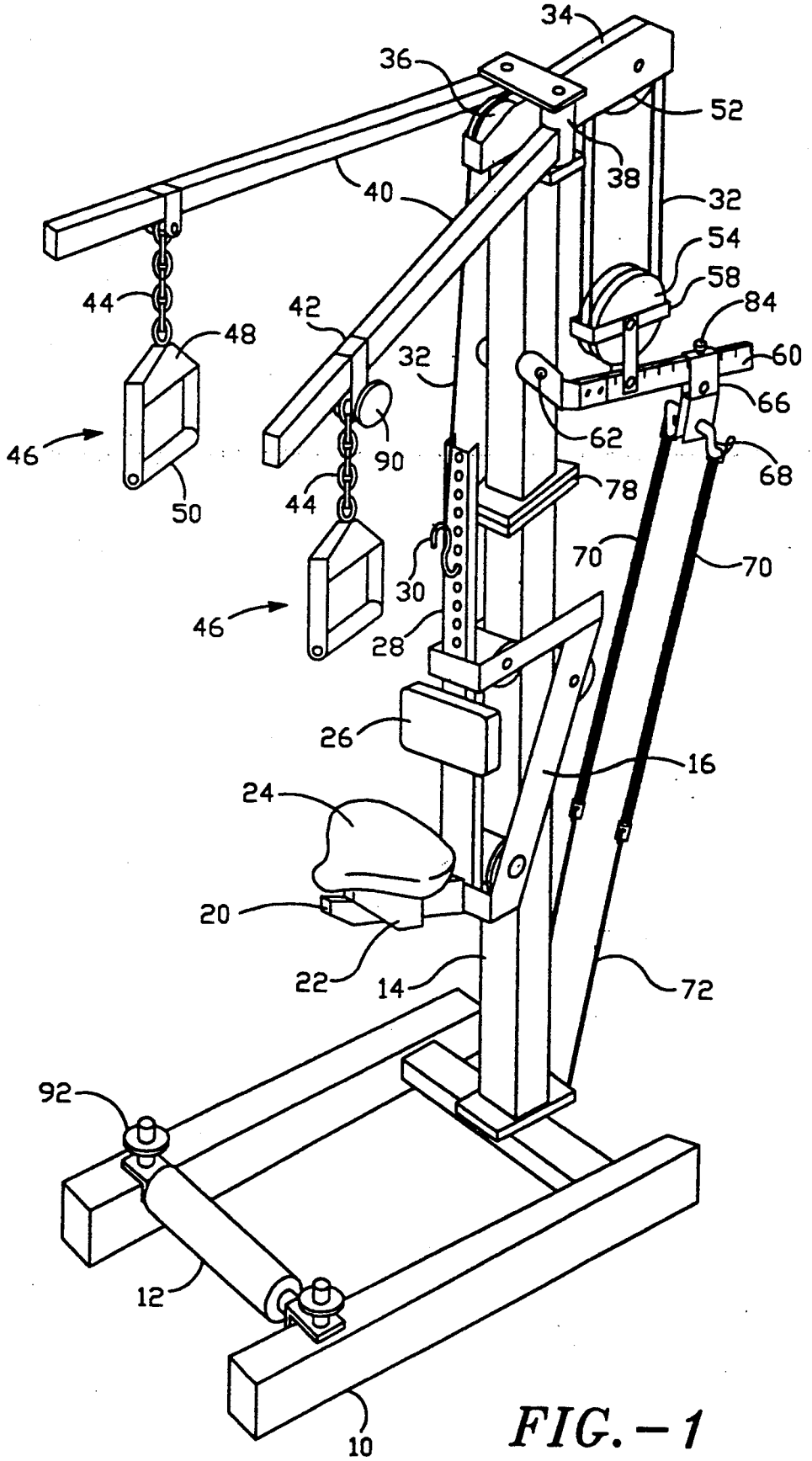
FIG. 1 is a perspective view of the apparatus of the present invention.
Figure 2:
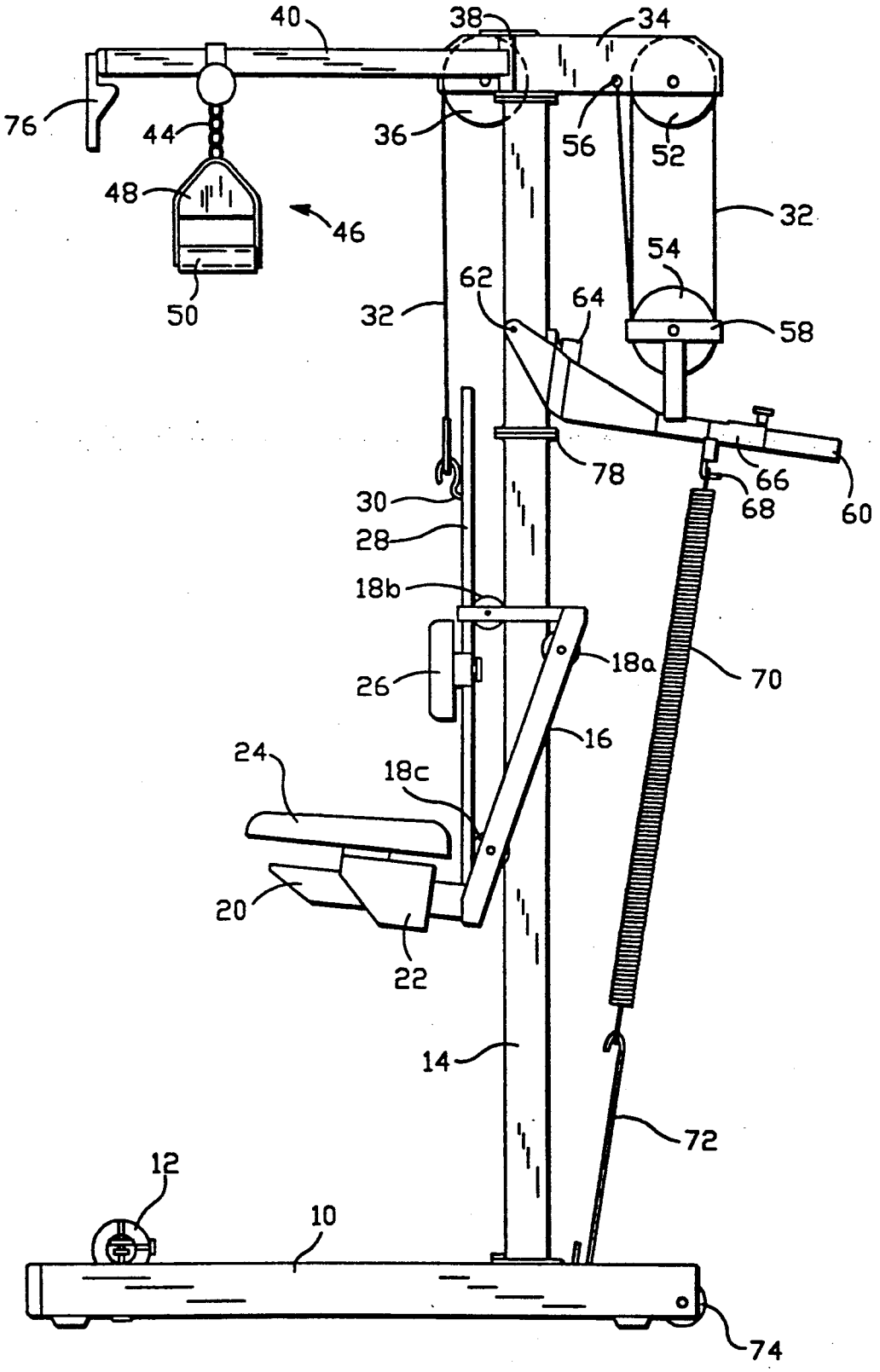
FIG. 2 is a side view of the apparatus.

With reference to FIGS. 1 and 2, an upright column 14 forms the core of the apparatus, providing support from a base 10 which rests on a surface. Mounted on the column 14 is the carriage frame 16 for providing vertical motion along the column. The carriage motion along the column is facilitated by rollers 18*a*, 8*b*, and 18*c*. In operation, the weight bearing rollers 18*a* and 18*c* are located on opposite sides of the column. Roller 18*b* is a secondary roller and serves to preserve proper alignment of the carriage during its upward travel.

The roller carriage supports the seat 24 on seat post 20 which extends outwardly from the carriage. The angle of the seat post with respect to horizontal is adjustable. The seat 24 is connected to the seat post on a rolling seat mounting 22. Alternatively, the seat may be pivoted to its support. This mounting allows the user to either select a comfortable seat position and fix the seat in that place, or to allow the seat to slide horizontally or perhaps pivot during the exercise operation, thereby also providing an abdominal exercise.

Above the seat 24 are arms 40 extending outwardly from the top of the upright column 14, each having a handle 46 suspended below. The handles are connected to the arms by chains 44 having an adjustable length and an adjustable position along the arm. The chain attachment point on the arm is determined by sliding bracket 42. Excess chain length is stored in the handle chain container 48.

The fundamental exercise envisioned has the user sitting on the rollable seat 24, grasping handles 46 for balance, and then performing a squatting motion, lowering the seat. From the lowered position the lifting action of the seat assists the user in regaining a standing position. It is this ability to support and lift a person through a range of motion which distinguishes the apparatus. The exercise is repeated rapidly to provide an aerobic workout. The lifting force described is provided by a spring 70 operably connected to the seat by a cable 32. The cable is routed through pulleys 36, 52, 54, then connected to a lever 60 attached to the spring 70.

The cable 32 is attached to the rollable carriage frame 16 by a hook 30 designed to fit the cable attachment rack 28 on the upper portion of the carriage. Multiple holes exist in the cable attachment rack for the purpose of a quick and easy seat height adjustment. The cable is then directed up and over the top of the upright column via single pulley 36. This pulley is mounted in a pulley housing 34 positioned as a header on top of the column. The header also includes hinges 38 at the attachment points of the arms 40. The pulley housing is cantilevered out over the back of the apparatus and also houses the upper pulleys 52 of a block and tackle system. The cable 32 is fed over the single pulley, through the upper block pulleys down to a second block of pulleys 54, then anchored to the pulley housing at point 56, shown only in FIG. 2.

The lower pulleys 54 are mounted in case 58 which is attached to a lever 60. The lever arm is pivotably attached at one end to the upright column 14 at point 62. The pulley system in combination with the lever stretch the springs 70 which provide an opposing force to lift the seat 24.

The column 14 is fabricated in two pieces joined at junction 78. This allows the device to be broken down for shipping or storage. The column acts as the principal support for various mechanical elements associated with the device, and as a rail guide for directing the range of motion during exercise. The column is attached to the base 10 which provides stability necessary to keep the column upright in operation. A set of wheels 74, shown in FIG. 2, is provided to allow easier transport of the apparatus. One person can move the exerciser by rocking the device back onto the wheels then rolling the unit to a desired location. Adjustable foot restraint 12 is optionally provided to keep a user's feet on the ground during exercise. The restraint is movable in horizontal and vertical directions and may be set by individuals by using foot restraint knobs 92 according to personal preference.

Figure 3:
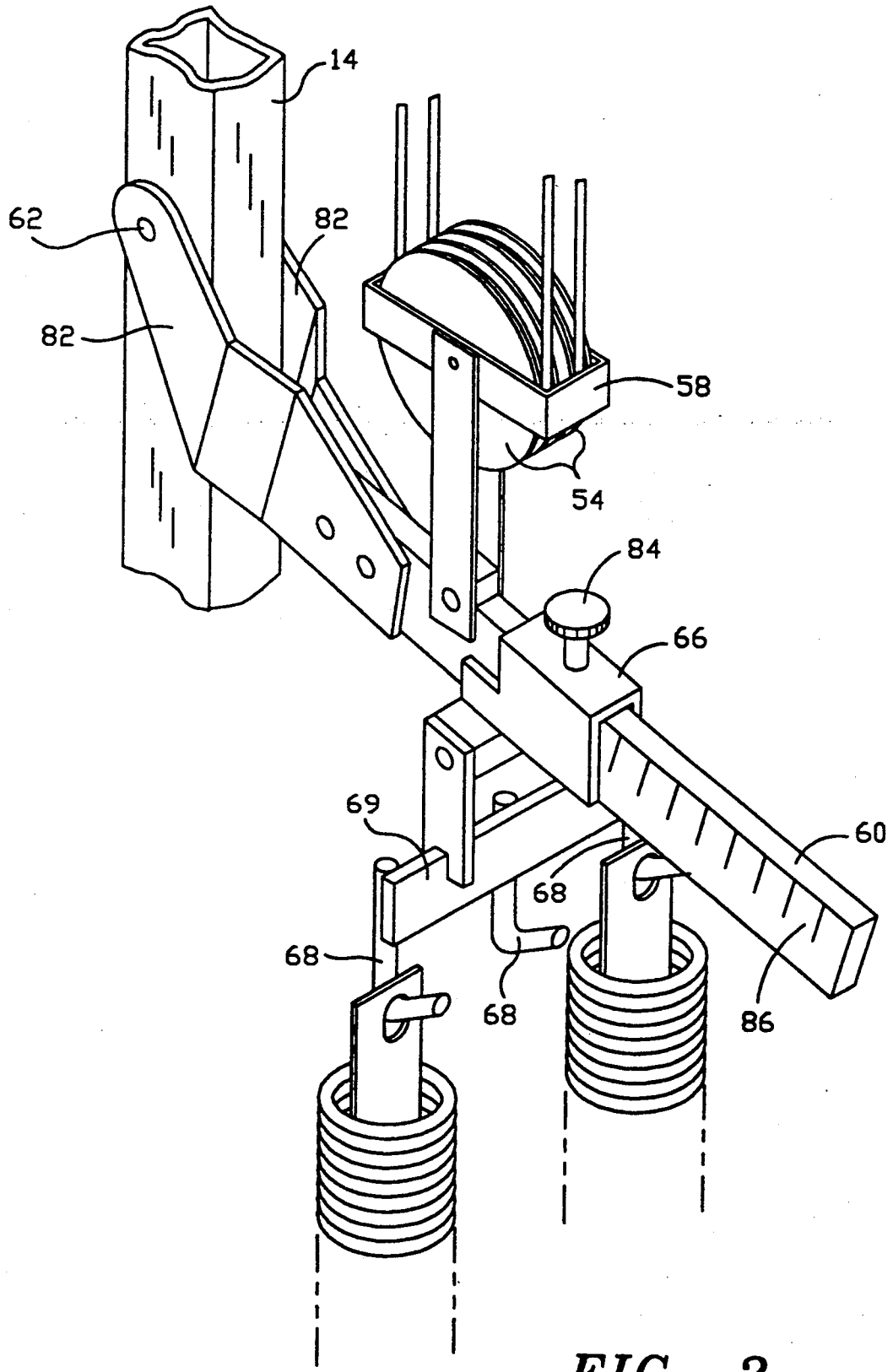
FIG. 3 is a perspective view of a detail of the lever arm assembly shown in FIG. 1.

FIG. 3 shows the spring-lever assembly in greater detail. The three main components in this structure are the lever 60, the spring hanging assembly 66, and the lower pulley block 58. The lever is connected to the column 14 by a pair of lever arm plates 82 which straddle the column. The pivot point 62 is established by a shaft which runs through both plates and the column. The plates are connected to a straight rigid bar 60 which forms the actual lever arm.

Attached to the lever arm reference numeral 60 immediately behind the plates 82 is the lower pulley block 58 housing a set of two pulleys 54, providing a mechanical advantage in the system. The force tensioning the cable is transferred to the springs through this attachment region on the lever arm.

Further away from the pivot point on the lever arm 60 is the spring attachment device. This consists of a sliding member 66 attached to the lever arm and a spring hanger 69 attached to the bottom of the sliding member underneath the arm. The sliding member has a thumbscrew 84 on top which allows the sliding member to be fixed to a selected spot on the lever. This sets an effective lever arm for the springs to work upon. Note in the sketches that there are three hooks 68 on hanger 69 for hanging one to three springs. This allows the setting of separate restoring force levels. A scale 86 is provided on the lever arm for reference. The user may vary the sliding member on the lever arm and the seat height on the carriage to fine tune the exact force desired.

The restoring force is applied as follows. When the seat 24 is set for a standing position the only force supported by the cable 32 is the weight of the seat and carriage frame 16. Because this force is negligible compared to the weight of a user, generally an equilibrium exists with the springs 70 fully contracted. In this configuration the restoring force is essentially zero.

As the seat 24 is lowered by the addition of a user's weight tension on the cable 32 is transferred through the pulleys 36, 52 and 54 to the lever arm 60. The pulleys retard the amount of stretch of the springs 70, although the amount of seat motion can be substantial. A four-to-one reduction of cable motion is preferred. For example, if the seat moves 28 inches, the cable at the lever arm will move only seven inches. The upward lever motion causes springs attached to the lever to stretch. The lever arm provides a mechanical advantage to the springs. The net effect is a force tending to restore the seat to its equilibrium position. Due to the elastic nature of the springs, the force is proportional to the magnitude of the seat's displacement from its vertical equilibrium position.

Returning to FIG. 2, the invention may also include a status monitor 76 for providing a user the ability to keep track of several parameters of the exercise. The monitor 76 is placed on the end of one of the upper arms 40. This position is in easy reach of a person exercising. The device functions may include a timer for following the length of the exercise and a counter for monitoring the number of repetitions performed. These functions may be triggered by a switch 64 located so as to respond to motion of the lever arm 60. The switch actuates the counter only. The timer is adjusted and turned on and off manually by the user. The status monitor may also provide a pacer function. The pacer mode emits a tone at regularly spaced intervals determined by the user. The pacer allows a user to follow a regular cadence helping to optimize time spent exercising.

Figure 4:
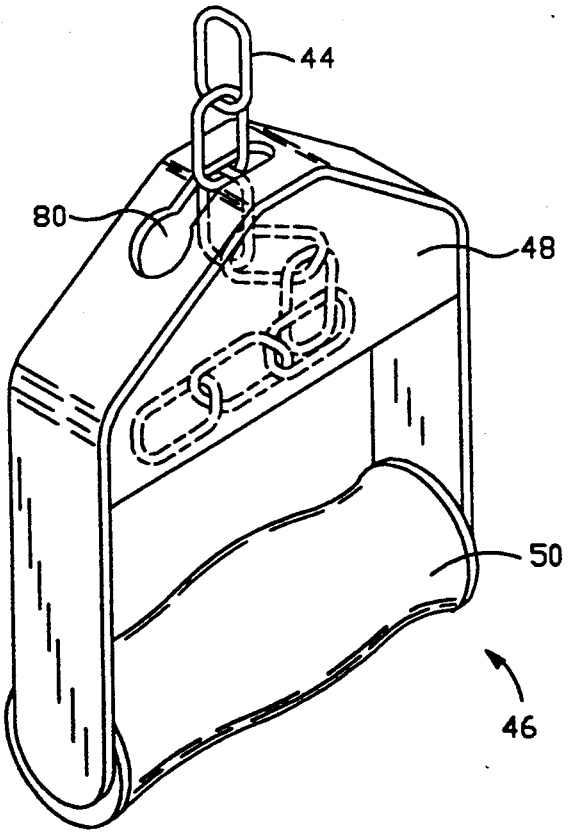
FIG. 4 is an enlarged perspective view of a handle shown in FIG. 1.

As seen in FIG. 4, the handle 46, with contoured grip 50, allows chain 44 to be set at any comfortable length, while excess links are stored inside the top portion of the handle in container 48. Chain can be added or removed from the container through the round portion of the key shaped slot 80. To set the chain at a particular point, the chain is slid over to the narrow section of the slot which stops the chain. This feature is effective because chain is formed from alternating perpendicular links having a width greater than their thickness, the slot width is made to pass one orientation not the other.

The simple design of the apparatus allows many variations of the fundamental exercise to be performed. For example, the ability to change the chain length, and thus the height of the stirrup shaped handles 46, creates an opportunity to perform several exercises based on different handle positions. With the handles at or above the shoulders in the standing position, the person exercising can work the upper body in a manner similar to a pull-up. With the handles at waist height in the standing position, a push-up type exercise is possible. Again, in both of these embodiments, the lifting force of the seat may be adjusted to provide the workout level desired.

Figure 5:
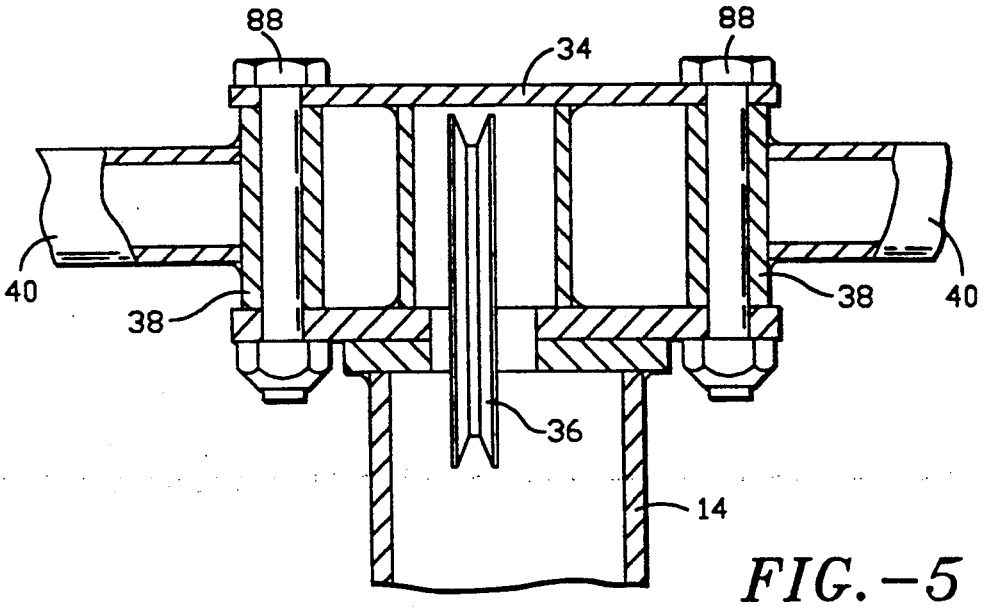
FIG. 5 is an enlarged cross sectional view of the upright column header shown in FIG. 1 showing the arm hinges, pulley housing, and front pulley.

FIG. 5 shows a cut away view of the column header including the arm hinges 38, the pulley housing 34 and the single pulley 36. These structures have been integrated into a single assembly. The arm hinges 38 allow the pivotable arms to be swept through a range of positions from straight forward to opposed extension on either side of the apparatus. The arms 40 are connected to the assembly by the hinge pins 88 which run through the pulley housing and the ends of the arms. The single pulley is mounted in the center of the housing and revolves about an axis not shown.

Figure 5A:
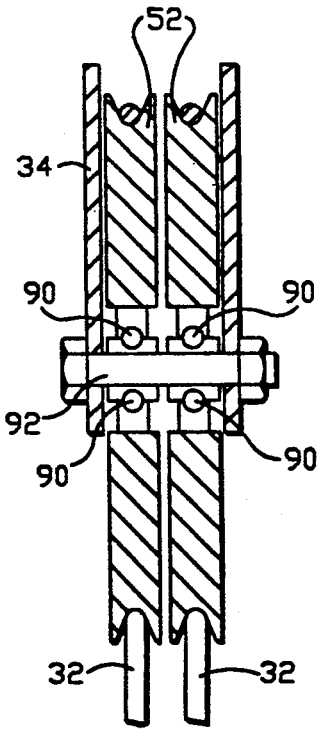
FIG. 5A is an enlarged cross section of the upper pulley block of the apparatus shown in FIG. 1.

FIG. 5A is a cut away view of the upper pulley block. The assembly is mounted within pulley housing 34, the pulley mechanism being fixed by axle 92. The pulleys 52 are connected to the lower pulley block 58 shown in FIG. 1 by cable 32. Bearings 90 smooth the pulley motion by reducing friction.

Further types of exercise are possible by changing the angle between the upper arms 40. The spread arms 40 provide an exercise for working the muscles of the upper back. Closed arms work more of the bicep or tricep groups. In addition to the exercises noted, the apparatus may be used in yet other ways to provide a complete fitness program. In one exercise, the person exercising's arms are extended outward without using the handles 46. From this position, the user squats down as in the regular exercise, however now much more of the force required to stand is exerted by the user's legs. This type of exercise therefore isolates the muscles of the legs. A similar exercise isolating the upper body is easily envisioned; a person would need only to lift the legs and place all the weight on the arms. In both exercises, the restoring force of the seat may be set to the needs of each user.

The weight supporting action of the device provides an effect similar to swimming. Work is performed not against a heavy weight, but by the multiple repetition of a light action. The simulated reduction of weight is useful to those undergoing therapy. Knee surgery, for example, reduces the amount of weight the user can support by himself. The present invention allows a controllable amount of pressure to be placed on areas requiring therapy.

I claim:

1. A multipurpose exercise apparatus comprising,
an upright rail column,
a pair of arms mounted to said rail column, each arm being generally horizontal and having a handle suspended therefrom,
a seat rollably mounted on said rail column, said seat having a vertical range of motion along said rail column, said seat being at a level below said arms, and
adjustable restoring means operatively attached to said seat for applying a controllable upward restoring force to said seat, said force being proportional to the vertical displacement of said seat along said rail column and tending to restore the seat to a rest position.

2. The apparatus of claim 1 wherein said restoring means is a counter-balance comprising a spring bias means coupled to the seat for restoring the seat to said rest position.

3. The apparatus of claim 2 wherein said restoring means further comprises a lever having a first end with a pivot joint at said rail column and a second end extending from the column, the spring bias means mounted to said lever and a cable connecting the lever with the seat.

4. The apparatus of claim 3 wherein said cable is connected to the seat via at least three axially spaced apart pulleys.

5. A multipurpose exercise apparatus comprising,
a support base,
an upright column affixed to said base,
a rollable frame mounted on said upright column for vertical motion along the column,
a seat mounted on the rollable frame,
a pair of arms mounted to the top of said rail column and extending horizontally out over the seat, said arms supporting a pair of handles suspended below said arms, said arms being vertically stationary relative to said upright column,
a lever arm having an end pivotally connected to said column on a side opposite said seat,
a spring tensioning assembly connected to said lever arm and to said base, and
means for applying a restoring force to said seat, said means employing a mechanical advantage element to connect said spring tensioning assembly to said rollable frame via said lever arm, the upward restoring force applied to the seat being proportional to the distance said seat is vertically displaced from a rest position.

6. A multipurpose exercise apparatus comprising,
a support base,
an upright rail column attached to said support base,
a pair of horizontal arms pivotably attached to the top of the rail column, said arms pivoting in a horizontal plane, said arms being vertically fixed,
a pair of handles suspended below said horizontal arms, each handle suspended by a variable length of chain attached to one of said arms,
a rollable frame mounted on said rail column, said frame being restrained to a vertical range of motion along the rail column,
a seat movably mounted to said rollable frame,
seat restoring means operatively attached to said seat for developing and applying an adjustable counterbalancing restoring force to the seat along the rail column, said restoring means having a rest condition, said seat having a rest position when said restoring means is in said rest condition, and
adjustable means for selectively varying the height of said rest position of said seat, said adjustable means being an attachment of said seat to said restoring means.

7. The apparatus of claim 6 wherein said seat restoring means employs a lever to provide a mechanical advantage to a spring coupled to said seat via a cable, said restoring means providing a restoring force to said seat which is proportional to the distance the seat is displaced from a user determined equilibrium position.

8. The apparatus of claim 6 wherein said rollable frame supports an adjustable backrest.

9. The apparatus of claim 8 wherein said backrest is adjustable in a vertical direction along said rail column.

10. The apparatus of claim 6 further comprising an adjustable foot restraint connected to said support base.

11. The apparatus of claim 6 further comprising rolling means attached to said support base for transporting the apparatus.

12. A multipurpose exercise apparatus comprising, a support base, an upright column affixed to said base, a rollable frame mounted on said upright column for vertical motion along the column, a seat mounted on the rollable frame, a pair of arms mounted to the top of said rail column and extending horizontally out over the seat, said arms supporting a pair of handles suspended below said arms, said arms being pivotably mounted, the arms having a range of motion in a horizontal plane between a parallel position above the seat and an open position in which the arms are positioned on opposite sides of the rail column, a lever arm having an end pivotally connected to said column on a side opposite said seat, a spring tensioning assembly connected to said lever arm and to said base, and means for applying a restoring force to said seat, said means employing a mechanical advantage element to connect said spring tensioning assembly to said rollable frame via said lever arm, the upward restoring force applied to the seat being proportional to the distance said seat is vertically displaced from a rest position.

* * * * *